US011756505B2

(12) United States Patent
Xu et al.

(10) Patent No.: US 11,756,505 B2
(45) Date of Patent: Sep. 12, 2023

(54) PEAK LUMINANCE CONTROL TO ENABLE HIGHER DISPLAY BRIGHTNESS

(71) Applicant: Apple Inc., Cupertino, CA (US)

(72) Inventors: Yang Xu, San Jose, CA (US); Jie Won Ryu, Santa Clara, CA (US); Kingsuk Brahma, Mountain View, CA (US); Koorosh Aflatooni, Los Altos Hills, CA (US); Marc Joseph DeVincentis, Palo Alto, CA (US); Mohammad Ali Jangda, Santa Clara, CA (US); Paolo Sacchetto, Cupertino, CA (US); Shengkui Gao, San Jose, CA (US); Sinan Alousi, Campbell, CA (US); Yafei Bi, Los Altos Hills, CA (US); Chun Lu, San Jose, CA (US)

(73) Assignee: Apple Inc., Cupertino, CA (US)

( * ) Notice: Subject to any disclaimer, the term of this patent is extended or adjusted under 35 U.S.C. 154(b) by 129 days.

(21) Appl. No.: 17/217,827

(22) Filed: Mar. 30, 2021

(65) Prior Publication Data

US 2021/0304703 A1 Sep. 30, 2021

Related U.S. Application Data

(60) Provisional application No. 63/003,218, filed on Mar. 31, 2020.

(51) Int. Cl.
*G09G 5/10* (2006.01)

(52) U.S. Cl.
CPC ..... *G09G 5/10* (2013.01); *G09G 2320/0233* (2013.01); *G09G 2320/0633* (2013.01); *G09G 2340/16* (2013.01); *G09G 2360/141* (2013.01)

(58) Field of Classification Search
CPC ..... G09G 5/10; G09G 2320/0233; G09G 2320/0633; G09G 2340/16; G09G 2360/141
See application file for complete search history.

(56) References Cited

U.S. PATENT DOCUMENTS

| | | | | |
|---|---|---|---|---|
| 9,881,553 | B2 | 1/2018 | Chen et al. | |
| 10,089,959 | B2 | 10/2018 | Jangda et al. | |
| 10,297,191 | B2 | 5/2019 | Hoffman | |
| 10,878,782 | B1 | 12/2020 | Guzman et al. | |
| 2007/0047808 | A1 * | 3/2007 | Choe | G06T 5/009 382/169 |

(Continued)

FOREIGN PATENT DOCUMENTS

KR 20160077166 A * 7/2016

*Primary Examiner* — Ricardo Osorio
(74) *Attorney, Agent, or Firm* — Fletcher Yoder, P.C.

(57) ABSTRACT

Systems, methods, and devices are provided for providing intra-frame luminance scaling to avoid drawing excessive power while still providing exceptional brightness. An instantaneous average pixel luminance of an electronic display may be determined. The instantaneous average pixel luminance may correspond to an amount of light currently being emitted by the electronic display due to a previous image frame and a current image frame. Based at least in part on the instantaneous average pixel luminance, the luminance of a subset of pixels of image data of the current image frame may be adjusted, thereby allowing the electronic display to operate at a relatively high brightness level without exceeding a power limit.

25 Claims, 14 Drawing Sheets

(56) References Cited

U.S. PATENT DOCUMENTS

| | | | | |
|---|---|---|---|---|
| 2008/0037867 | A1* | 2/2008 | Lee | H04N 9/68<br>348/E9.053 |
| 2008/0062091 | A1* | 3/2008 | Stewart | G09G 3/3241<br>345/76 |
| 2016/0314760 | A1* | 10/2016 | Jangda | G09G 3/3208 |
| 2017/0186404 | A1* | 6/2017 | Hajjar | G09G 5/10 |
| 2022/0028353 | A1* | 1/2022 | Lee | G09G 3/3233 |

* cited by examiner

PEAK LUMINANCE CONTROL TO ENABLE HIGHER DISPLAY BRIGHTNESS

CROSS-REFERENCE TO RELATED APPLICATIONS

This application is a non-provisional application claiming priority to U.S. Provisional Application No. 63/003,218, entitled "PEAK LUMINANCE CONTROL TO ENABLE HIGHER DISPLAY BRIGHTNESS," filed Mar. 31, 2020, which is hereby incorporated by reference in its entirety for all purposes.

SUMMARY

A summary of certain embodiments disclosed herein is set forth below. It should be understood that these aspects are presented to provide the reader with a brief summary of these certain embodiments and that these aspects are not intended to limit the scope of this disclosure.

This disclosure relates to systems and methods to control luminance on an electronic display to enable the electronic display to display a brighter pixels and achieve a greater contrast range—that is, allowing some display pixels to display significantly higher brightness in many cases—while not exceeding an amount of power available to the electronic display. Electronic displays are found in numerous electronic devices, from mobile phones to computers, televisions, automobile dashboards, and many more. Individual display pixels of an electronic display may collectively produce images by permitting different amounts of light to be emitted from each display pixel. Electronic displays with self-emissive display pixels produce their own light. Self-emissive display pixels may include any suitable light-emissive elements, including light-emitting diodes (LEDs) such as organic light-emitting diodes (OLEDs) or micro-light-emitting diodes (μLEDs). The amount of light emitted by each self-emissive display pixel may draw a different amount of electrical energy from the power supply. Display pixels that are programmed to emit more light will draw more power than display pixels programmed to emit less light. The total amount of light that can be emitted by the pixels of the electronic display at any one time may be limited by the total amount of power that can be supplied to the electronic display.

Increasingly, image frames of image data that may be displayed on an electronic display may have a higher dynamic range. The higher the dynamic range of the image frame, the greater the difference in contrast between the darkest image pixels and the brightest image pixels. To be able to display such content, an electronic display may be enabled to display pixels with relatively higher brightness.

As mentioned above, however, emitting more light causes the display pixel to draw more power. If too many display pixels drew too much power at one time, this could cause the power supply to be exceeded, which could result in a device malfunction. Thus, the image data that is displayed on the electronic display may be adjusted to prevent the electronic display from ever drawing too much power at any one time. However, always limiting the maximum brightness of each display pixel to satisfy a possible worst-case scenario (e.g., limiting the maximum brightness of each display pixel to avoid drawing excessive power in case all display pixels are at maximum brightness) would mean that images that are not the worst-case scenario would always draw even less power than could possibly be drawn (and, therefore, that pixels that could have otherwise provided more light would have been limited).

Accordingly, the systems and methods of this disclosure may provide a real-time adjustment of image data to prevent the power supply from being exceeded while also allowing display pixels to be as bright as possible depending on the content. To do this, intra-frame luminance scaling logic (e.g., circuitry or instructions executed on a processor) may selectively scale the brightness of image data as it is received for programming onto the electronic display. The scaling may be considered "intra-frame" because the intra-frame luminance scaling logic may scale different parts of a single image frame differently depending on the total amount light being emitted by the electronic display at that instant. Thus, the intra-frame luminance scaling logic may monitor an instantaneous average pixel luminance by keeping a running accumulation of the light currently being emitted by the display pixels of the electronic display. This may entail the total amount of light emitted by those display pixels still programmed with image data from the previous frame in combination with the display pixels now programmed with image data for the current frame. Based at least in part on this accumulation, the intra-frame luminance scaling logic may adjust the image data for the new frame just before it is programmed into the electronic display. This may prevent the total amount of light emitted by the display from causing too much power to be drawn from the power supply when the content of the new frame turns out to have a large amount of particularly bright content. At the same time, however, this may allow content with a lower amount of particularly bright content to be displayed at full brightness with little or no adjustment—all without exceeding the supply of available power to the display.

BRIEF DESCRIPTION OF THE DRAWINGS

Various aspects of this disclosure may be better understood upon reading the following detailed description and upon reference to the drawings described below.

DETAILED DESCRIPTION

Figure 1:
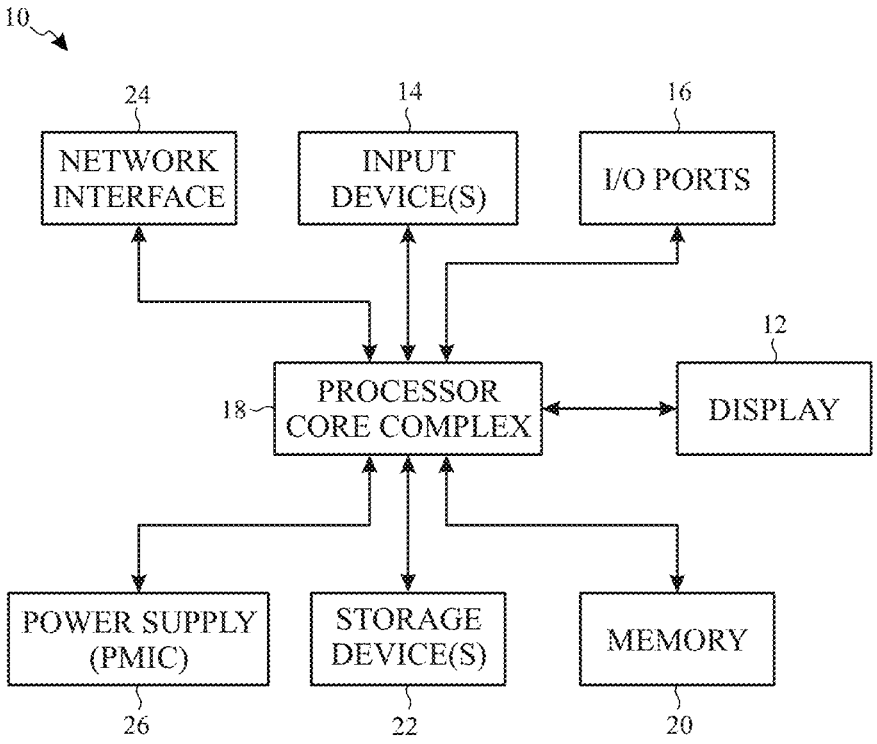
FIG. 1 is a schematic block diagram of an electronic device, in accordance with an embodiment.

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "including" and "having" are intended to be inclusive and mean that there may be additional elements other than the listed elements. Additionally, it should be understood that references to "some embodiments," "embodiments," "one embodiment," or "an embodiment" of the present disclosure are not intended to be interpreted as excluding the existence of additional embodiments that also incorporate the recited features. Furthermore, the phrase A "based on" B is intended to mean that A is at least partially based on B. Moreover, the term "or" is intended to be inclusive (e.g., logical OR) and not exclusive (e.g., logical XOR). In other words, the phrase A "or" B is intended to mean A, B, or both A and B.

As mentioned above, the systems and methods of this disclosure may provide a real-time adjustment of image data to prevent the power supply from being exceeded while also allowing display pixels to be as bright as possible depending on the content. To do this, intra-frame luminance scaling logic (e.g., circuitry or instructions executed on a processor) may selectively scale the brightness of image data as it is received for programming onto the electronic display. The intra-frame luminance scaling logic may keep a running accumulation of the light emitted by the display pixels of the electronic display. This may entail the total amount of light emitted by those display pixels still programmed with image data from the previous frame in combination with the display pixels now programmed with image data for the current frame. Based at least in part on this accumulation, the intra-frame luminance scaling logic may adjust the image data for the new frame just before it is programmed into the electronic display. This may prevent the total amount of light emitted by the display from causing too much power to be drawn from the power supply when the content of the new frame turns out to have a large amount of particularly bright content. At the same time, however, this may allow content with a lower amount of particularly bright content to be displayed with little or no adjustment—all without exceeding the supply of available power to the display.

With this in mind, an example of an electronic device 10, which includes an electronic display 12 that may benefit from these features, is shown in FIG. 1. The electronic device 10 may be any suitable electronic device, such as a computer, a mobile (e.g., portable) phone, a portable media device, a tablet device, a television, a handheld game platform, a personal data organizer, a virtual-reality headset, a mixed-reality headset, a vehicle dashboard, and/or the like. Thus, it should be noted that FIG. 1 is merely one example of a particular implementation and is intended to illustrate the types of components that may be present in an electronic device 10.

In addition to the electronic display 12, as depicted, the electronic device 10 includes one or more input devices 14, one or more input/output (I/O) ports 16, a processor core complex 18 having one or more processors or processor cores and/or image processing circuitry, memory 20, one or more storage devices 22, a network interface 24, and a power supply 26. The various components described in FIG. 1 may include hardware elements (e.g., circuitry), software elements (e.g., a tangible, non-transitory computer-readable medium storing instructions), or a combination of both hardware and software elements. It should be noted that the various depicted components may be combined into fewer components or separated into additional components. For example, the memory 20 and the storage devices 22 may be included in a single component. Additionally or alternatively, image processing circuitry of the processor core complex 18 may be disposed as a separate module or may be disposed within the electronic display 12.

The processor core complex 18 is operably coupled with the memory 20 and the storage device 22. As such, the processor core complex 18 may execute instruction stored in memory 20 and/or a storage device 22 to perform operations, such as generating or processing image data. The processor core complex 18 may include one or more microprocessors, one or more application specific processors (ASICs), one or more field programmable logic arrays (FPGAs), or any combination thereof.

In addition to instructions, the memory 20 and/or the storage device 22 may store data, such as image data. Thus, the memory 20 and/or the storage device 22 may include one or more tangible, non-transitory, computer-readable media that store instructions executable by processing circuitry, such as the processor core complex 18, and/or data to be processed by the processing circuitry. For example, the memory 20 may include random access memory (RAM) and the storage device 22 may include read only memory (ROM), rewritable non-volatile memory, such as flash memory, hard drives, optical discs, and/or the like.

The network interface 24 may enable the electronic device 10 to communicate with a communication network and/or another electronic device 10. For example, the network interface 24 may connect the electronic device 10 to a personal area network (PAN), such as a Bluetooth network, a local area network (LAN), such as an 802.11x Wi-Fi network, and/or a wide area network (WAN), such as a $4^{th}$ Generation (4G), Long Term Evolution (LTE), or $5^{th}$ Generation (5G) cellular network. In other words, the network interface 24 may enable the electronic device 10 to transmit data (e.g., image data) to a communication network and/or receive data from the communication network.

The power supply 26 may provide electrical power to operate the processor core complex 18 and/or other components in the electronic device 10, for example, via one or more power supply rails. Thus, the power supply 26 may include any suitable source of electrical power, such as a rechargeable lithium polymer (Li-poly) battery and/or an alternating current (AC) power converter. A power management integrated circuit (PMIC) may control the provision and generation of electrical power to the various components of the electronic device 10.

The I/O ports 16 may enable the electronic device 10 to interface with another electronic device 10. For example, a portable storage device may be connected to an I/O port 16, thereby enabling the electronic device 10 to communicate data, such as image data, with the portable storage device.

The input devices 14 may enable a user to interact with the electronic device 10. For example, the input devices 14 may include one or more buttons, one or more keyboards, one or more mice, one or more trackpads, and/or the like. Additionally, the input devices 14 may include touch sensing components implemented in the electronic display 12. The touch sensing components may receive user inputs by detecting occurrence and/or position of an object contacting the display surface of the electronic display 12.

In addition to enabling user inputs, the electronic display 12 may facilitate providing visual representations of information by displaying one or more images (e.g., image frames or pictures). For example, the electronic display 12 may display a graphical user interface (GUI) of an operating system, an application interface, text, a still image, or video content. To facilitate displaying images, the electronic display 12 may include a display panel with one or more display pixels. The display pixels may represent sub-pixels that each control a luminance of one color component (e.g., red, green, or blue for an RGB pixel arrangement).

The electronic display 12 may display an image by controlling the luminance of its display pixels based at least in part image data associated with corresponding image pixels in image data. In some embodiments, the image data may be generated by an image source, such as the processor core complex 18, a graphics processing unit (GPU), an image sensor, and/or memory 20 or storage 22. Additionally, in some embodiments, image data may be received from another electronic device 10, for example, via the network interface 24 and/or an I/O port 16.

Figure 2:
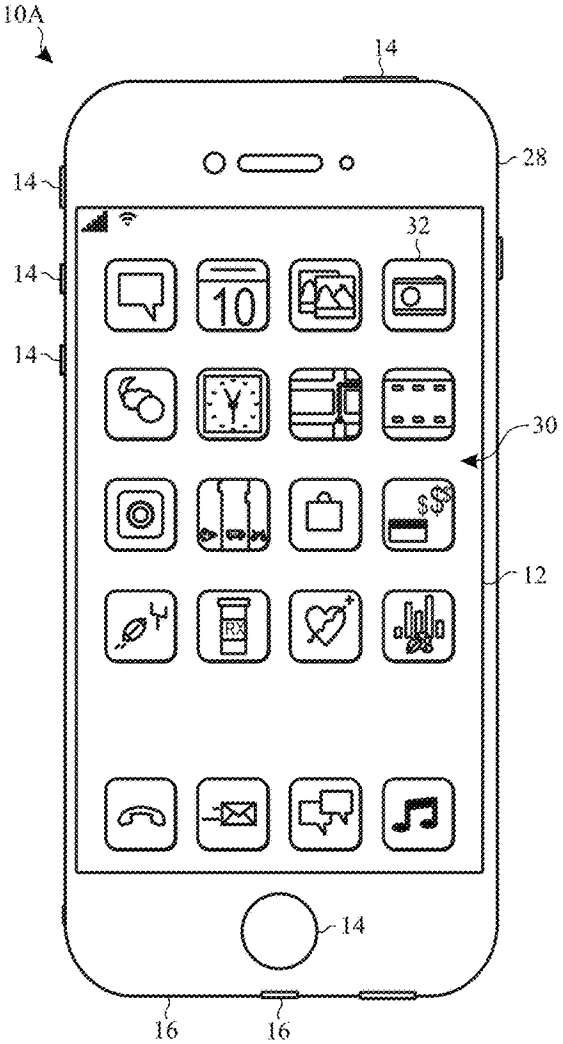
FIG. 2 is a front view of a mobile phone representing an example of the electronic device of FIG. 1, in accordance with an embodiment.

One example of the electronic device 10, specifically a handheld device 10A, is shown in FIG. 2. The handheld device 10A may be a portable phone, a media player, a personal data organizer, a handheld game platform, and/or the like. For example, the handheld device 10A may be a smart phone, such as any iPhone® model available from Apple Inc.

The handheld device 10A includes an enclosure 28 (e.g., housing). The enclosure 28 may protect interior components from physical damage and/or shield them from electromagnetic interference. In the depicted embodiment, the electronic display 12 is displaying a graphical user interface (GUI) 30 having an array of icons 32. By way of example, when an icon 32 is selected either by an input device 14 or a touch sensing component of the electronic display 12, an application program may launch.

Input devices 14 may be provided through the enclosure 28. As described above, the input devices 14 may enable a user to interact with the handheld device 10A. For example, the input devices 14 may enable the user to activate or deactivate the handheld device 10A, navigate a user interface to a home screen, navigate a user interface to a user-configurable application screen, activate a voice-recognition feature, provide volume control, and/or toggle between vibrate and ring modes. The I/O ports 16 also open through the enclosure 28. The I/O ports 16 may include, for example, a Lightning® or Universal Serial Bus (USB) port.

Figure 3:
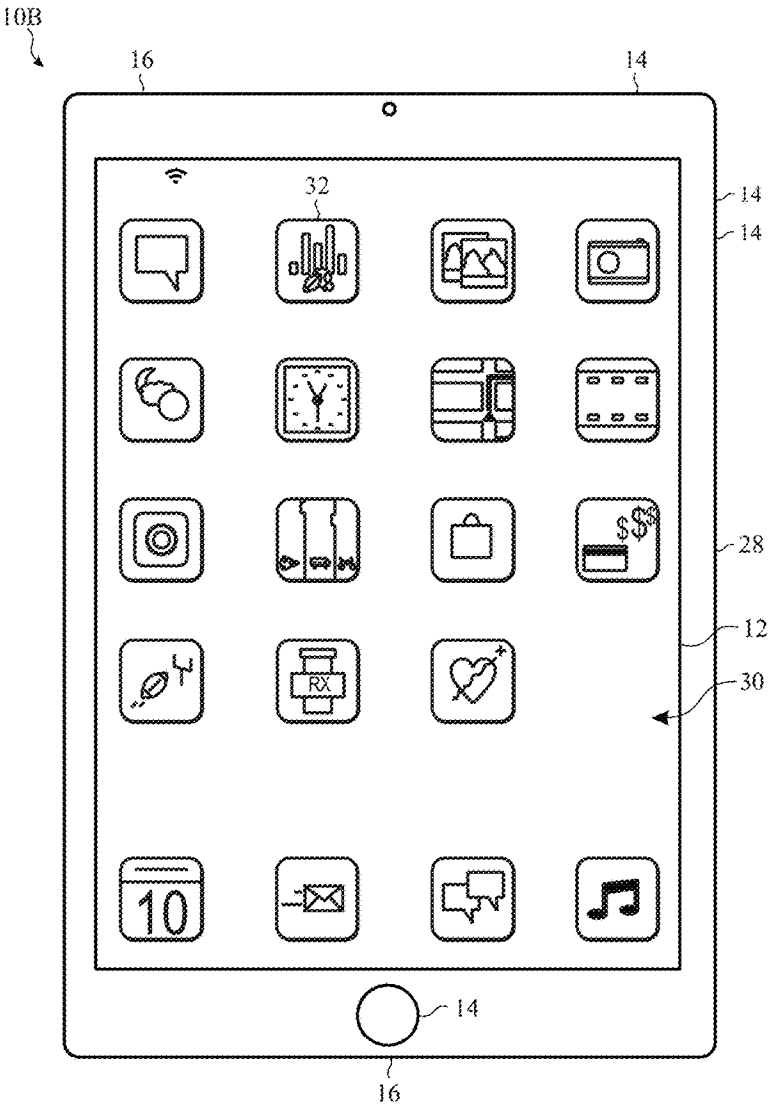
FIG. 3 is a front view of a tablet device representing an example of the electronic device of FIG. 1, in accordance with an embodiment.
Figure 4:
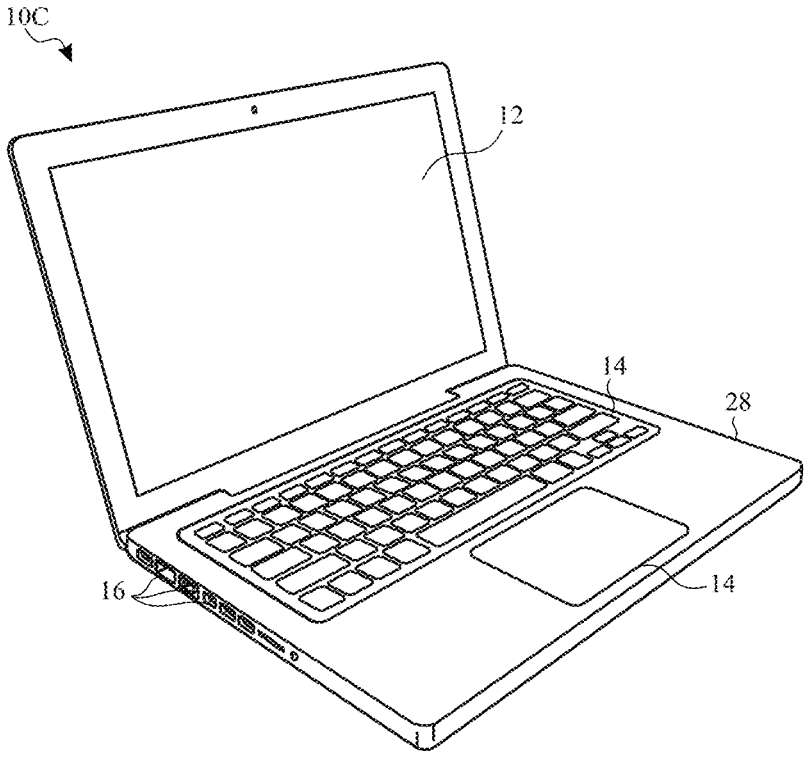
FIG. 4 is a front view of a notebook computer representing an example of the electronic device of FIG. 1, in accordance with an embodiment.
Figure 5:
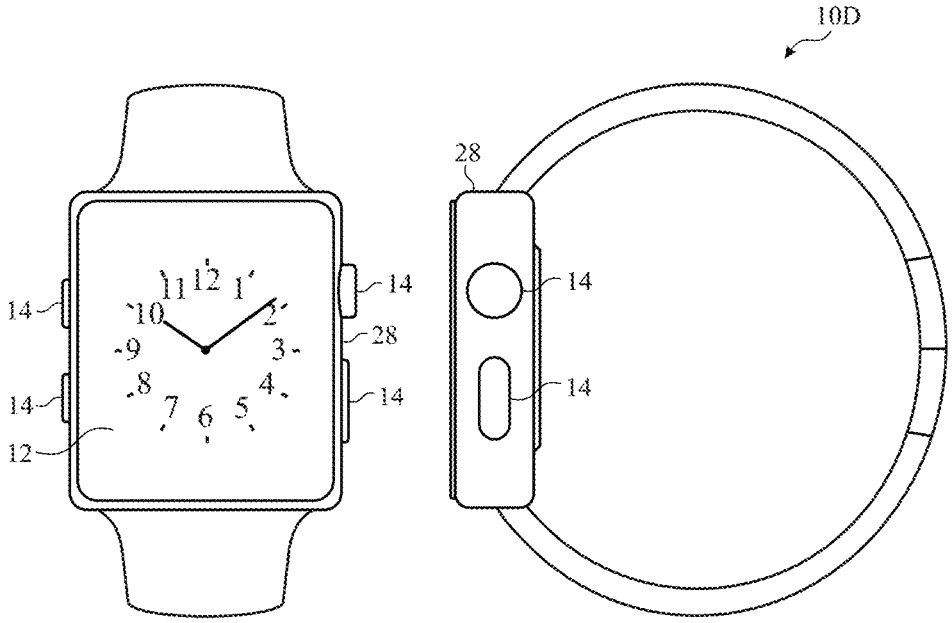
FIG. 5 are front and side views of a watch representing an example of the electronic device of FIG. 1, in accordance with an embodiment.

The electronic device 10 may take the form of a tablet device 10B, as shown in FIG. 3. By way of example, the tablet device 10B may be any iPad® model available from Apple Inc. A further example of a suitable electronic device 10, specifically a computer 10C, is shown in FIG. 4. By way of example, the computer 10C may be any MacBook® or iMac® model available from Apple Inc. Another example of a suitable electronic device 10, specifically a watch 10D, is shown in FIG. 5. By way of example, the watch 10D may be any Apple Watch® model available from Apple Inc. As depicted, the tablet device 10B, the computer 10C, and the watch 10D all include respective electronic displays 12, input devices 14, I/O ports 16, and enclosures 28.

Figure 6:
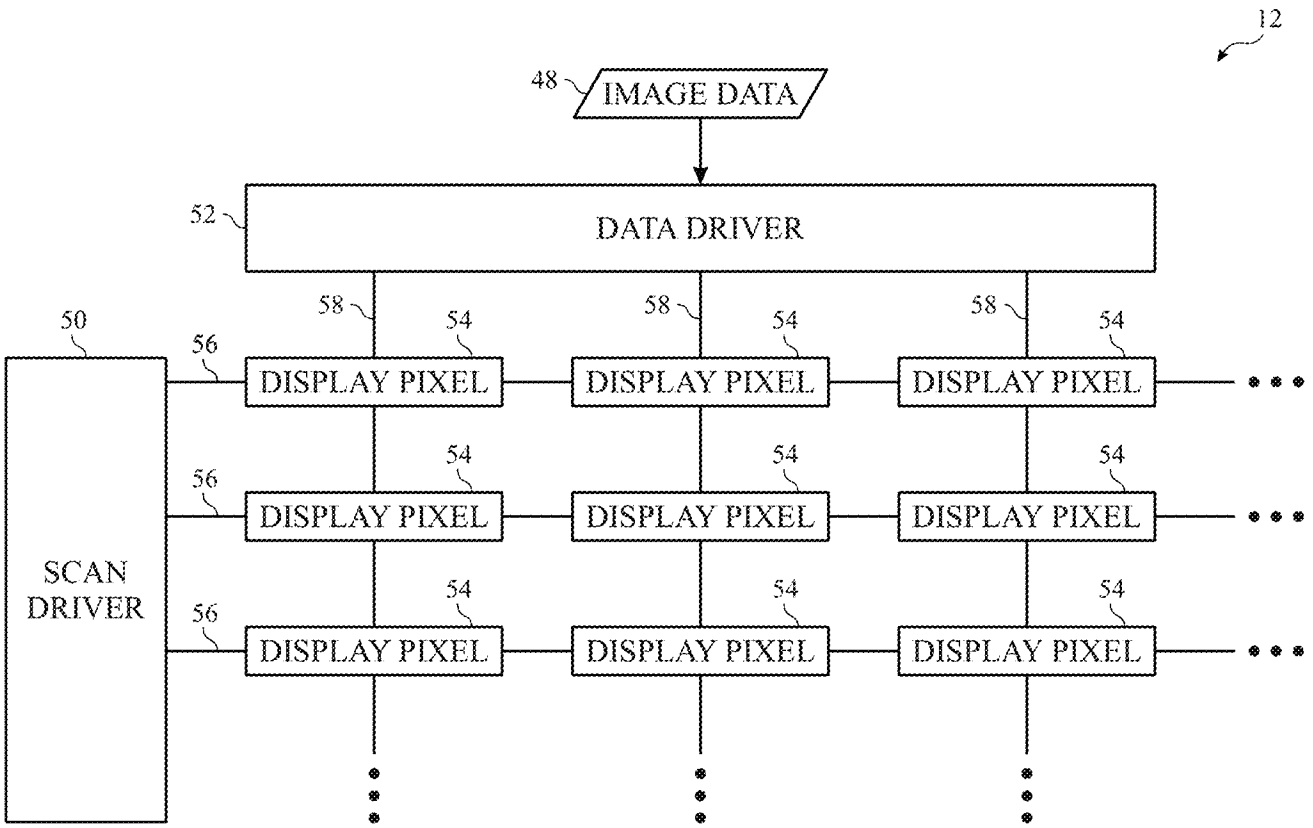
FIG. 6 is a block diagram of an electronic display of the electronic device, in accordance with an embodiment.

As shown in FIG. 6, the electronic display 12 may receive image data 48 for display on the electronic display 12. The electronic display 12 includes display driver circuitry that includes scan driver 50 circuitry and data driver 52 circuitry that can program the image data 48 onto display pixels 54. The display pixels 54 may each contain one or more self-emissive elements, such as a light-emitting diodes (LEDs) (e.g., organic light emitting diodes (OLEDs) or micro-LEDs (μ-LEDs)). Different display pixels 54 may emit different colors. For example, some of the display pixels 54 may emit red light, some may emit green light, and some may emit blue light. Thus, the display pixels 54 may be driven to emit light at different brightness levels to cause a user viewing the electronic display 12 to perceive an image formed from different colors of light. The display pixels 54 may also correspond to hue and/or luminance levels of a color to be emitted and/or to alternative color combinations, such as combinations that use cyan (C), magenta (M), or the like. Moreover, each display pixel 54 may draw a different amount of power from the power supply 26 depending on the amount of light emitted by that display pixel 54. The more light emitted, the more power consumed.

The scan driver 50 may provide scan signals (e.g., pixel reset, data enable) on scan lines 56 to control the display pixels 54 by row. For example, the scan driver 50 may cause a row of the display pixels 54 to become enabled to receive a portion of the image data 48 from data lines 58 from the data driver 52. In this way, an image frame of image data 48 may be programmed onto the display pixels 54 row by row. Other examples of the electronic display 12 may program the display pixels 54 in groups other than by row. In general, however, the image data 48 for a particular image frame is received by, and programmed into, the electronic display 12 in pieces. For example, the image data 48 maybe received as a stream of pixels that can be programmed into the display pixels 54 on a row-by-row basis.

Figure 7:
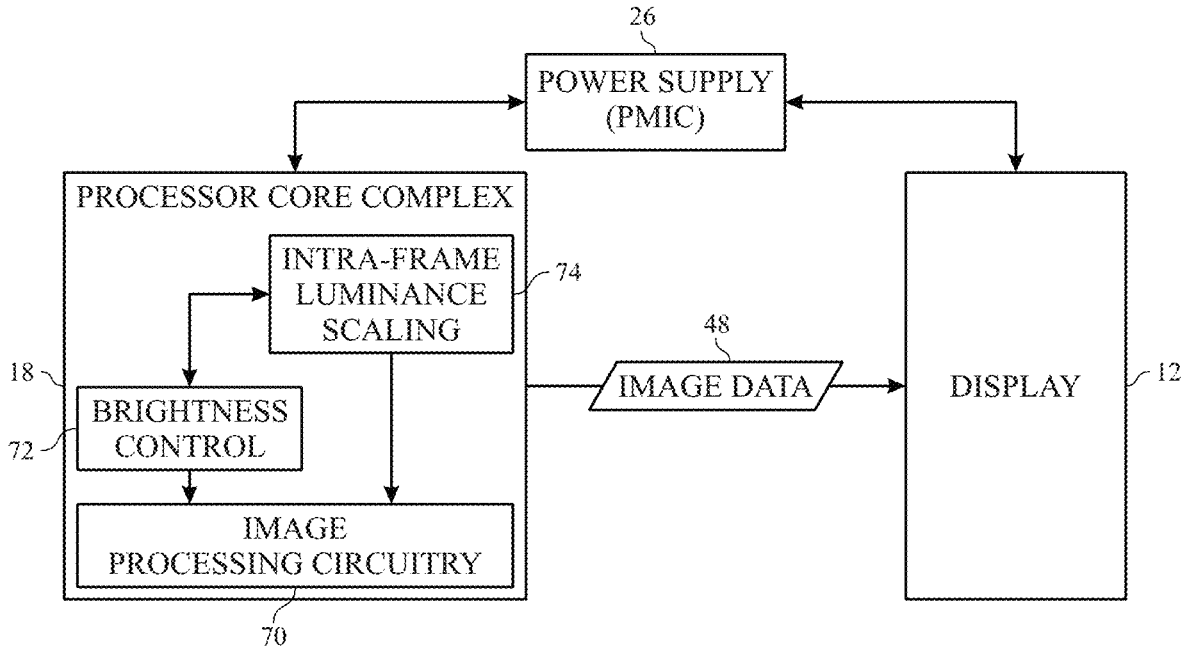
FIG. 7 is a block diagram of a system for displaying image data on the electronic display at high brightness and without exceeding a power supply using intra-frame luminance scaling logic in processing circuitry, in accordance with an embodiment.
Figure 8:
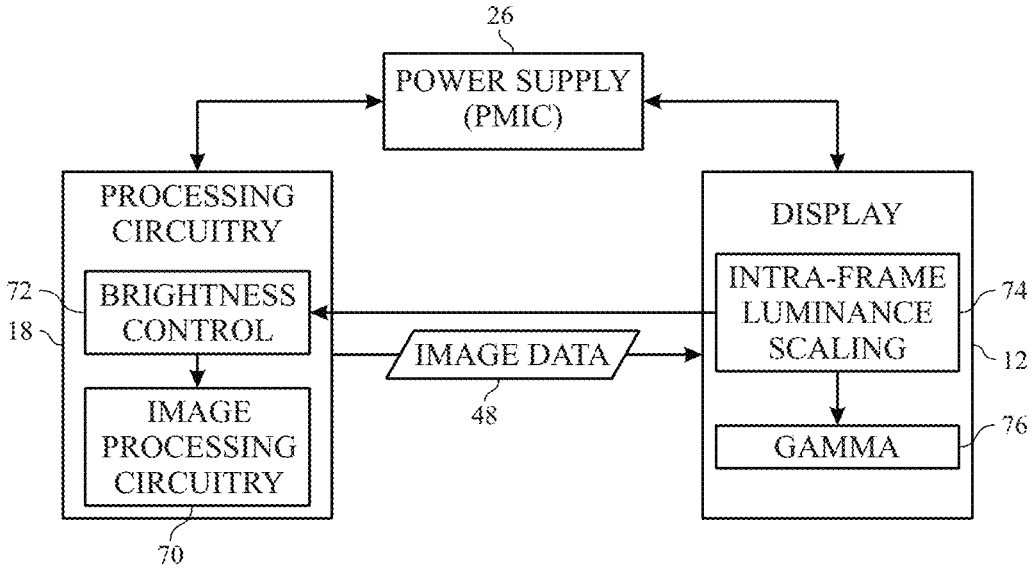
FIG. 8 is a block diagram of a system for displaying image data on the electronic display at high brightness and without exceeding a power supply using intra-frame luminance scaling logic disposed on the electronic display, in accordance with an embodiment.

Since the entire frame of image data 48 may not be known in advance, the total power that will be drawn by the electronic display when the entire frame of image data 48 is programmed onto the electronic display 12 may not be known in advance. As such, intra-frame luminance scaling may be applied to the image data 48 based at least in part on an accumulated total luminance being emitted by the electronic display 12. Block diagrams of examples of such a system are shown in FIGS. 7 and 8. As illustrated, the power supply 26 supplies power both to the processor core complex 18 and the electronic display 12. The processor core complex 18 may generate and send the image data 48 to the electronic display 12. Image processing circuitry 70, which may include a display pipeline or memory-to-memory scaling and rotating (MSR) circuitry, may be used to prepare the image data 48 for display on the electronic display 12.

Brightness control 72 may determine a global display brightness value (DBV) for the electronic display 12. The brightness control 72 may take any suitable form, such as instructions running on the processor core complex 18 or as circuitry (e.g., one or more processing blocks of an application-specific integrated circuit (ASIC)), or both. In one particular example, the brightness control 72 may be a component of an operating system of the electronic device 10. For instance, a user may be able to increase or decrease a global brightness of the electronic display 12 via a graphical user interface (GUI) of the electronic device 10. The image processing circuitry 70 may take into account the global display brightness value when processing the image data 48. Additionally or alternatively, the global display brightness value may be provided along with the image data 48 to the electronic display 12. For instance, the electronic display 12 may adjust the conversion of the image data 48 into programming signals that program the individual display pixels based at least in part on the global display brightness value.

The image processing circuitry 70 may process a frame of the image data 48 on a pixel-by-pixel basis, and the electronic display 12 may program the frame of the image data 48 on a row-by-row basis. To prevent the image data 48 from causing the electronic display 12 from exceeding a maximum available power from the power supply 26, intra-frame luminance scaling 74 may scale the luminance of the image data 48 mid-frame (e.g., in real time). The intra-frame luminance scaling 74 may likewise take any suitable form, such as instructions running on the processor core complex 18 or as circuitry (e.g., one or more processing blocks of an application-specific integrated circuit (ASIC)), or both. In the example of FIG. 7, the intra-frame luminance scaling 74 is shown as part of the processor core complex 18, but in FIG. 8, it is shown as a component of the electronic display 12. In some other examples, the intra-frame luminance scaling 74 may be disposed partly in the processor core complex 18 and partly on the electronic display 12. Additionally or alternatively, the intra-frame luminance scaling 74 may represent an image processing block in a display pipeline of the image processing circuitry 70. Since the ultimate luminance that will be displayed on the electronic display 12 affects the amount of power drawn by the electronic display 12, in these embodiments, the intra-frame luminance scaling 74 may be among the later processing blocks of the display pipeline (e.g., the last processing block before transmission to the electronic display 12).

The intra-frame luminance scaling 74 may track a total luminance being displayed by the electronic display 12, which may be referred to as an instantaneous average pixel luminance of the electronic display 12. Since the electronic display 12 is programmed row by row, some of the light emitted by the electronic display 12 will be due to display pixels that have been programmed with the current frame of image data 48, while the rest of the light emitted by the electronic display 12 will be due to display pixels that have not yet been programmed with the current frame of image data 48 and are still emitting light based on the previous frame of image data 48. Thus, the total luminance tracked by the intra-frame luminance scaling 74 (e.g., the instantaneous average pixel luminance) may include a running accumulation of an average pixel luminance for the electronic display 12 over one full image frame (including some pixels programmed with the current image frame and some pixels programmed with the previous frame). To ensure that the total luminance does not cause the electronic display 12 to draw too much power from the power supply 26, the intra-frame luminance scaling 74 may cause the luminance of the image data 48 to be scaled based on how close the running total of the luminance over one frame approaches the maximum allowable luminance. This will be described in more detail below.

When the intra-frame luminance scaling 74 determines to scale the luminance of the image data 48, it may do so by causing the image processing circuitry 70 to perform the scaling of certain rows of the image data as the pixels of the rows are being processed (e.g., as represented by FIG. 7) or directly (e.g., as represented by FIG. 8). Luminance scaling may take place while the image data 48 is in any suitable representation. For example, the luminance scaling may take place while the image data is in a linear domain, a gamma (e.g., gray scale) domain, and may take place as a digital or an analog operation. In the example of FIG. 8, luminance scaling may involve applying a scaling factor to gamma circuitry 76 that transforms the image data 48 into programming signals that are used to program the display pixels of the electronic display 12. Since the image processing circuitry 70 may be processing the image data 48 on a pixel-by-pixel basis, the expected luminance of the entire current frame may not be known in advance. As such, the luminance scaling of the image data 48 may take place within the current image frame to avoid drawing too much power from the power supply 26. Thus, the electronic display 12 may operate at a higher brightness most of the time without exceeding the power supply. This may allow the electronic display 12 to display higher dynamic range content.

Depending on the total luminance of the current frame or the amount of luminance scaling that is performed, the intra-frame luminance scaling 74 may indicate to the brightness control 72 that the global display brightness value should be reduced for a subsequent image frame. In the example of FIG. 8, where the intra-frame luminance scaling 74 is disposed in the display driver circuitry of the electronic display 12, a sideband channel may be used to communicate a request to reduce the global display brightness value for a subsequent image frame (e.g., a register of the electronic display 12 that is accessible by the processor core complex 18 or an interrupt).

Figure 9:
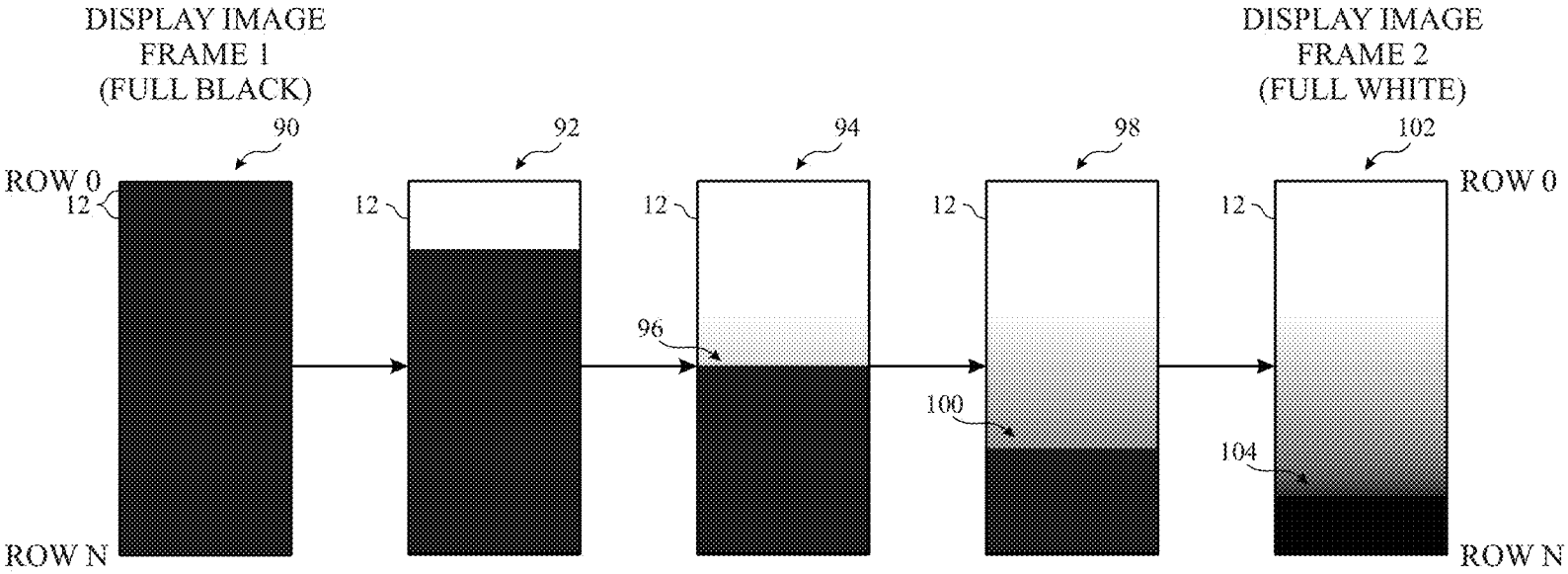
FIG. 9 illustrates an example of intra-frame luminance scaling in a worst-case scenario of transitioning from a fully black frame to a fully white frame, in accordance with an embodiment.

FIG. 9 illustrates intra-frame luminance scaling that may occur when the image frame changes from a fully black image frame 1 (i.e., no light is emitted) to a fully white image frame 2 at a maximum global display brightness value (i.e., all display pixels would be emitting maximum light if so programmed, potentially drawing excessive power from the power supply at some global display brightness values). Since the content of the new image frame is not known in advance, the intra-frame luminance scaling of the electronic device 10 may begin to scale the image data as the total instantaneous luminance increases past some threshold value.

The example of FIG. 9 takes place during one refresh of the electronic display 12 in which image data for a current frame (image frame 2) is programmed over the image data for a previous frame (image frame 1). At a time 90, all of the pixels of the electronic display 12 from Row 0 to Row N are programmed to display black (i.e., not emitting light). The electronic display 12 is refreshed with new image data row by row, and by a time 92, several rows have been programmed with image data to produce white. For example, the red, green, and blue display pixels of those rows may be programmed at full brightness, resulting in the appearance of white on those rows of the electronic display 12. As more rows of the display pixels are programmed to high brightness values, however, it becomes more likely that the electronic display 12 may approach the instantaneous limit of power that can be supplied by the power supply. As such, at a time 94, the luminance of the image data programmed into a row 96 of the display pixels may be scaled to reduce light emission. At a time 98, this may continue as the luminance of subsequent rows 100 are scaled further. Finally, at a time 102, the last of the image data may be programmed into the electronic display 12. To avoid drawing too much power, the luminance of some rows 104 of the display pixels may be completely scaled to 0 (i.e., not emitting any light). While this could produce a temporary transient artifact in this worst-case scenario, the next frame may be scaled to a lower global display brightness value that may avoid such instantaneous luminance scaling, and the electronic display 12 has been prevented from drawing excessive power while still able to operate at high brightness.

Figure 10:
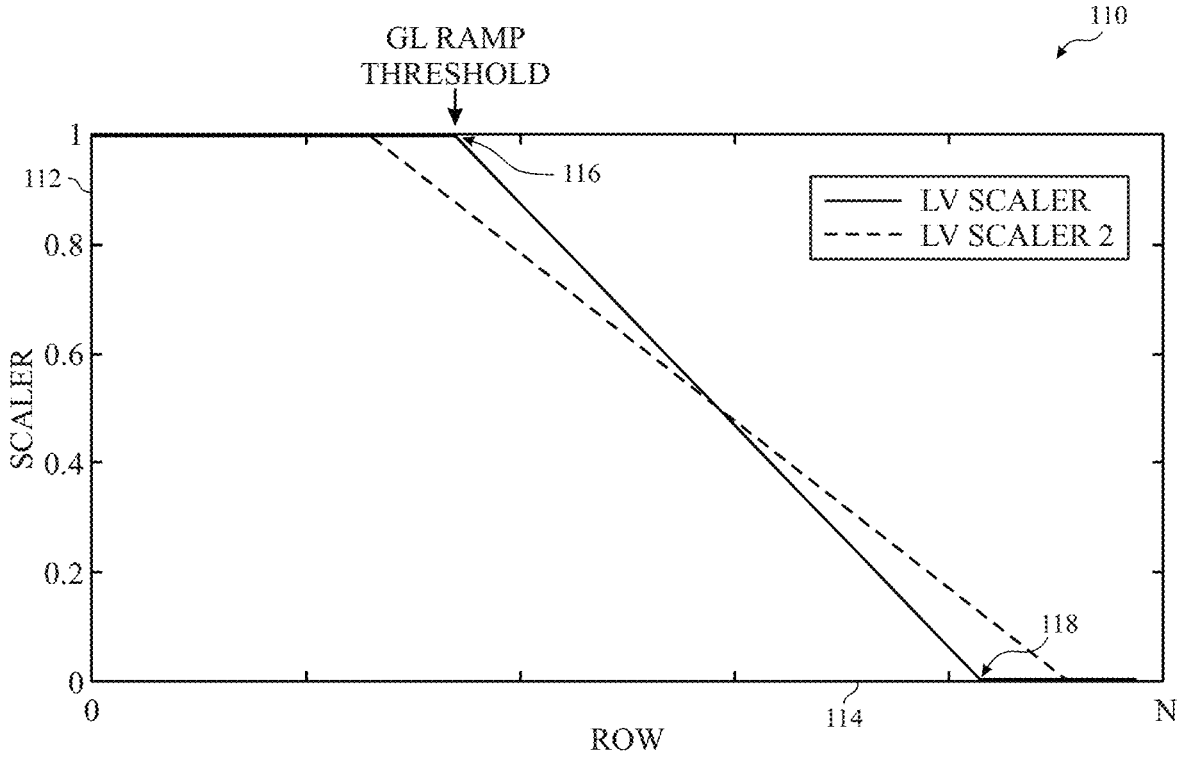
FIG. 10 is a plot showing scaling values applied to the image data in the example of FIG. 9, in accordance with an embodiment.

A plot 110 shown in FIG. 10 illustrates the luminance scaling applied in the example of FIG. 9. The plot 110 illustrates a scaling value (ordinate 112) between 0 to 1 that is applied to the image data of each row (abscissa 114) from Row 0 to Row N. Two curves represent a form of luminance scaling that may be applied. A first curve labeled Lv Scaler (solid line) represents a more abrupt scaling that starts later, while a second curve labeled Lv Scaler 2 (dashed line) represents a smoother scaling that starts earlier. The first curve (solid line) of the plot 110 of FIG. 10 corresponds to the scaling performed in the example shown in FIG. 9. Following this first curve (solid line), for the first of many rows, the scaling value applied to the image data is 1, meaning that the image data is not changed. In other words, the fully white image frame that is being programmed onto the electronic display 12 in FIG. 9 remains fully white for the first several rows. At a gray level (GL) ramp threshold 116, corresponding to the row 96, the luminance of the image data begins to be scaled down. Because Image Frame 1 of FIG. 9 is fully black (i.e., no light transmission from any display pixels), every non-black display pixel for Image Frame 2 will add to the total average pixel luminance of the electronic display 12. Thus, as additional rows of display pixels are programmed in the electronic display 12, the image data is scaled down according to the first curve (solid line) of the plot 110 of FIG. 10. This continues until the image data for additional pixels is scaled to 0 at a maximum average pixel luminance 118, beyond which point the electronic display 12 may not emit any more light or the electronic display 12 will exceed a power threshold and draw too much power from the power supply 26. This corresponds to the row 104 and below, where the display pixels display black (i.e., do not emit light).

Figure 11:
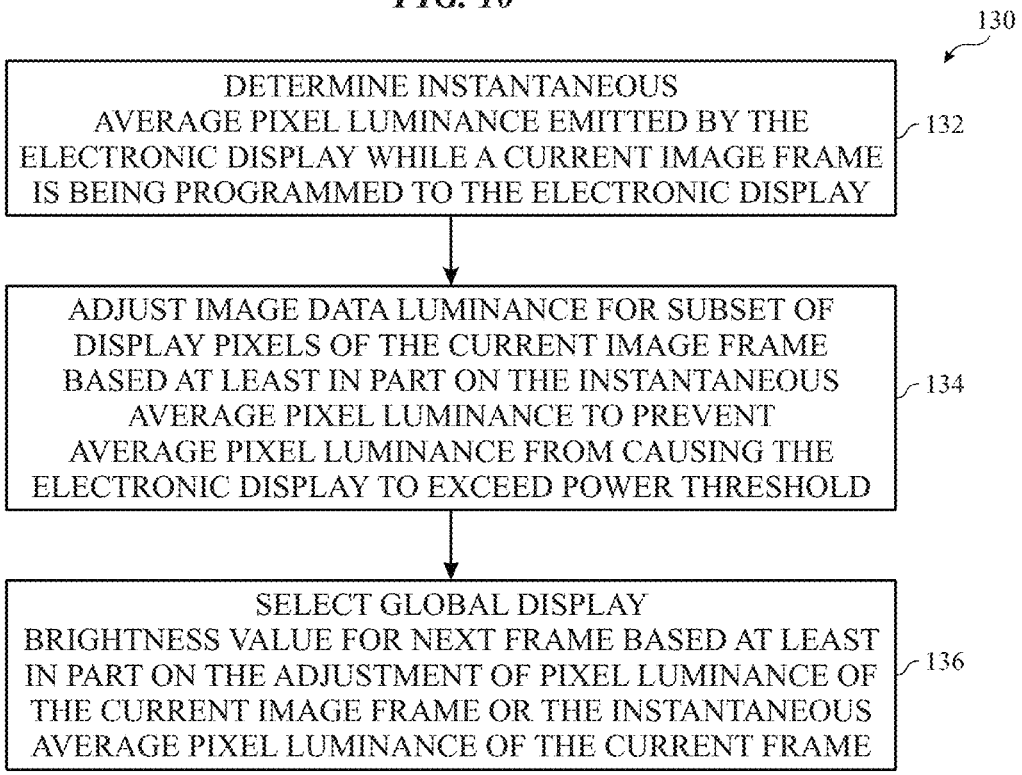
FIG. 11 is a flowchart of a method for performing intra-frame luminance scaling to enable higher display brightness while preventing excessive power from being drawn by the electronic display, in accordance with an embodiment.

One example of a method for performing luminance scaling by tracking the instantaneous luminance output by the electronic display is shown by a flowchart 130 of FIG. 11. The method of the flowchart 130 may be performed by any suitable circuitry (e.g., one or more processing blocks of an application-specific integrated circuit (ASIC)) or instructions (e.g., software or firmware) running on processing circuitry (e.g., the processor core complex). For example, the flowchart 130 may be performed by the intra-frame luminance scaling 74 implemented as instructions running on the processor core complex 18 or as circuitry (e.g., one or more processing blocks of an application-specific integrated circuit (ASIC)), or both, and/or the image processing circuitry 70.

At block 132 of the flowchart 130, an instantaneous average pixel luminance of the electronic display 12 may be determined while a current image frame is being programmed into the electronic display 12. The instantaneous average pixel luminance may be any suitable value corresponding to the amount of light currently being emitted by the electronic display 12. In one example, the instantaneous average pixel luminance represents a value between 0 and 1 that corresponds to the average brightness of the image data that has been sent to the electronic display for programming (e.g., image data that has been programmed into a first subset of the display pixels corresponding to a current frame and image data that was previously programmed into the rest of the display pixels corresponding to the previous frame). However, the total amount of light emitted by the electronic display 12 also depends on the global display brightness value (by which the image data is adjusted to achieve the total light output; the same image frame at different global display brightness values will result in different amounts of emitted light). Consider an example where the image data for all display pixels is a maximum gray level. If the global display brightness value is very low, the total amount of light emitted by the electronic display 12 may be relatively low. By contrast, if the global display brightness value is very high, the total amount of light emitted by the electronic display 12 could cause the electronic display 12 to draw more power than the power supply could provide. Therefore, the instantaneous average pixel luminance may be considered in combination with the global display brightness value with respect to intra-frame luminance scaling.

Indeed, at block 134, the luminance of a subset of the image data (e.g., for a current row or next row of display pixels) may be scaled based at least in part on the instantaneous average pixel luminance, taking into account the global display brightness value. Any suitable luminance scaling function may be used. For example, the function may depend on the instantaneous average pixel luminance and global display brightness. Certain examples will be discussed below with reference to FIGS. 15-20.

When, at block 134, the luminance of the image data is scaled to reduce the total light emission of the electronic display, this may suggest that the global display brightness value should be reduced in a subsequent frame. Thus, under those conditions, a global brightness may be selected for a subsequent frame that is lower than the current frame (block 136). In one example, a global display brightness value for a subsequent image frame (e.g., the next image frame or another future image frame) may be selected to result in no luminance scaling for the next frame if the image data remained the same. In another example, the global display brightness value for a subsequent image frame may be selected to result in less than some threshold amount of luminance scaling if the next frame if the image data remained the same.

Figure 12:
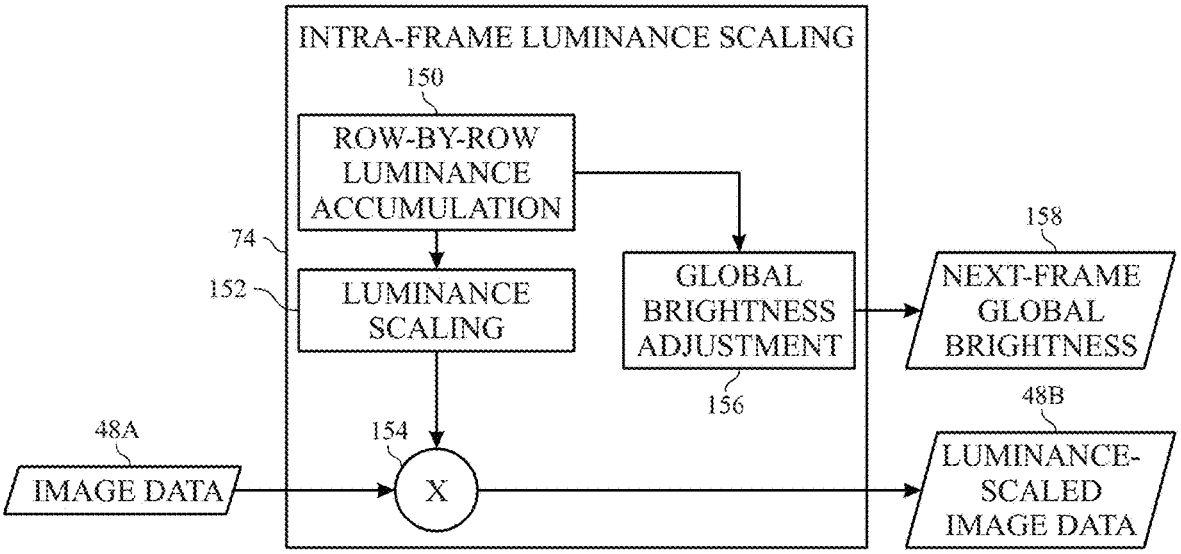
FIG. 12 is a block diagram of intra-frame luminance scaling logic that may be implemented in circuitry or as instructions executed on a processor, in accordance with an embodiment.

One example of a block diagram of the intra-frame luminance scaling 74 is shown in FIG. 12. As mentioned above, the intra-frame luminance scaling 74 may be implemented as instructions running on a processor (e.g., software or firmware running on the processor core complex 18 or other processing circuitry of the electronic device 10) or implemented as circuitry (e.g., one or more processing blocks of an application-specific integrated circuit (ASIC)), or both. In some cases, the intra-frame luminance scaling 74 may be disposed partly in the processor core complex 18 and partly on the electronic display 12. Additionally or alternatively, the intra-frame luminance scaling 74 may represent an image processing block in a display pipeline of the image processing circuitry 70.

The intra-frame luminance scaling 74 may include a row-by-row luminance accumulation 150 (e.g., row-by-row luminance accumulation circuitry) that tracks a current instantaneous average pixel luminance of the electronic display 12. The row-by-row luminance accumulation 150 may maintain a total accumulation of average pixel luminance for the electronic display 12 over one total frame. Thus, the total accumulation of average pixel luminance over one total frame may represent an instantaneous average pixel luminance that may include: (1) the average pixel luminance for those display pixels that have been programmed with image data for a current frame of image data and (2) the average pixel luminance for those display pixels that have not yet been programmed with the image data for the current frame of image data, and thus are still programmed with image data for a previous image frame. The row-by-row luminance accumulation 150 may accumulate the total average pixel luminance over one frame by accumulating an instantaneous average pixel luminance for each row of display pixels (e.g., divided by the total number of rows of the electronic display). In one example, the row-by-row luminance accumulation 150 may use a 1-column row buffer (e.g., located in the memory 20 or as a component of the row-by-row luminance accumulation 150). The 1-column row buffer may store one instantaneous average pixel luminance for each row. By accumulating all values of the 1-column row buffer, the instantaneous average pixel luminance of the entire electronic display 12 may be obtained.

Luminance scaling 152 (e.g., luminance scaling circuitry) may determine a scaling factor to apply to image data 48A for current pixels (e.g., a current row) of the current image frame based at least in part on the instantaneous average pixel luminance of the electronic display 12. As mentioned above, the total luminance output by the electronic display 12 may depend on both the instantaneous average pixel luminance due to the image data and the current global display brightness value for the electronic display. The higher the global display brightness value, the higher the total luminance output—and thus the higher the total power drawn—by the electronic display 12 for the same image data. Therefore, the luminance scaling 152 may consider both the instantaneous average pixel luminance and the global display brightness value.

In one example, the luminance scaling 152 may use a two-dimensional lookup table to determine a luminance scaling value that is a function of the instantaneous average pixel luminance and the global display brightness value. The luminance scaling 152 may apply the luminance scaling value to the incoming image data 48A via a multiplier 154, producing luminance-scaled image data 48B. The luminance-scaled image data 48B may be programmed for display on the electronic display 12. As such, the luminance-scaled image data 48B may be used by the row-by-row luminance accumulation 150 to determine the instantaneous average pixel luminance of the electronic display 12. In other cases, however, the row-by-row luminance accumulation 150 may use the image data 48A or some other estimation of the image data that has been displayed on the electronic display 12 for determining the instantaneous average pixel luminance of the electronic display 12.

The luminance scaling 152 may use any suitable function of luminance scaling to determine the luminance scaling value. Certain examples of such functions are discussed below with reference to FIGS. 15-20. In one example, mentioned above, such functions may be stored as a two-dimensional lookup table indexed to the instantaneous average pixel luminance and the global display brightness value. In other examples, the functions may be programmed and calculated directly by the luminance scaling 152.

The intra-frame luminance scaling 74 may also use a global brightness adjustment 156 (e.g., row-by-row luminance accumulation circuitry) to reduce the global display brightness value for a subsequent frame of image data in some situations. For example, the global brightness adjustment 156 may select a lower global display brightness value for a subsequent frame (e.g., the next frame) of image data based at least in part on the instantaneous average pixel luminance and the current global display brightness value and/or an amount of scaling by the luminance scaling 152. For instance, the global display brightness value for the subsequent frame may be selected so that a subsequent image frame (e.g., the next image frame or another future image frame) may avoid luminance scaling for the next frame if the image data remained the same, if the image data was less bright by some threshold, or if the image data increased in brightness by some threshold. In another example, the global display brightness value for a subsequent image frame may be selected to result in some threshold amount of luminance scaling if the next frame if the image data remained the same, if the image data was less bright by some threshold, or if the image data increased in brightness by some threshold. In one example, the global brightness adjustment 156 may use a lookup table indexed to a luminance threshold corresponding to an initial luminance scaling performed by the luminance scaling 152. In another example, the global brightness adjustment 156 may use and/or include a two-dimensional lookup table indexed to the average pixel luminance and the current global display brightness value.

The global brightness adjustment 156 may output a next-frame global display brightness value 158 to be used for a subsequent image frame. When the intra-frame luminance scaling 74 is disposed in the display driver circuitry of the electronic display 12, a sideband channel may be used to communicate a request to reduce the global display brightness value for a subsequent image frame (e.g., a register of the electronic display 12 that is accessible by the processor core complex 18 or an interrupt).

Figure 13:
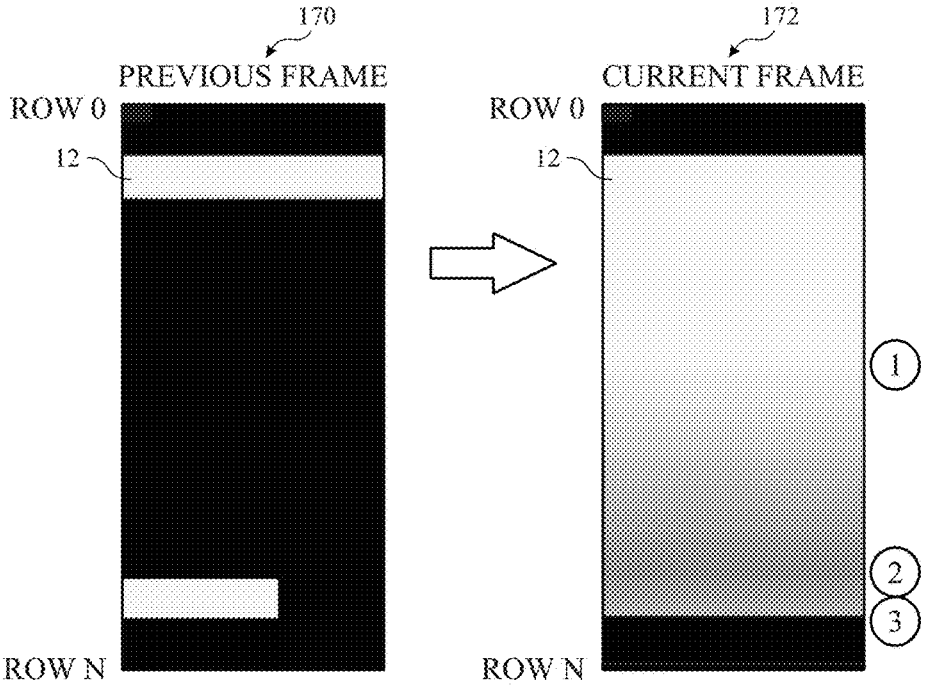
FIG. 13 illustrates another example of intra-frame luminance scaling when transitioning from displaying a previous image frame to displaying a current image frame on the electronic display, in accordance with an embodiment.
Figure 14:
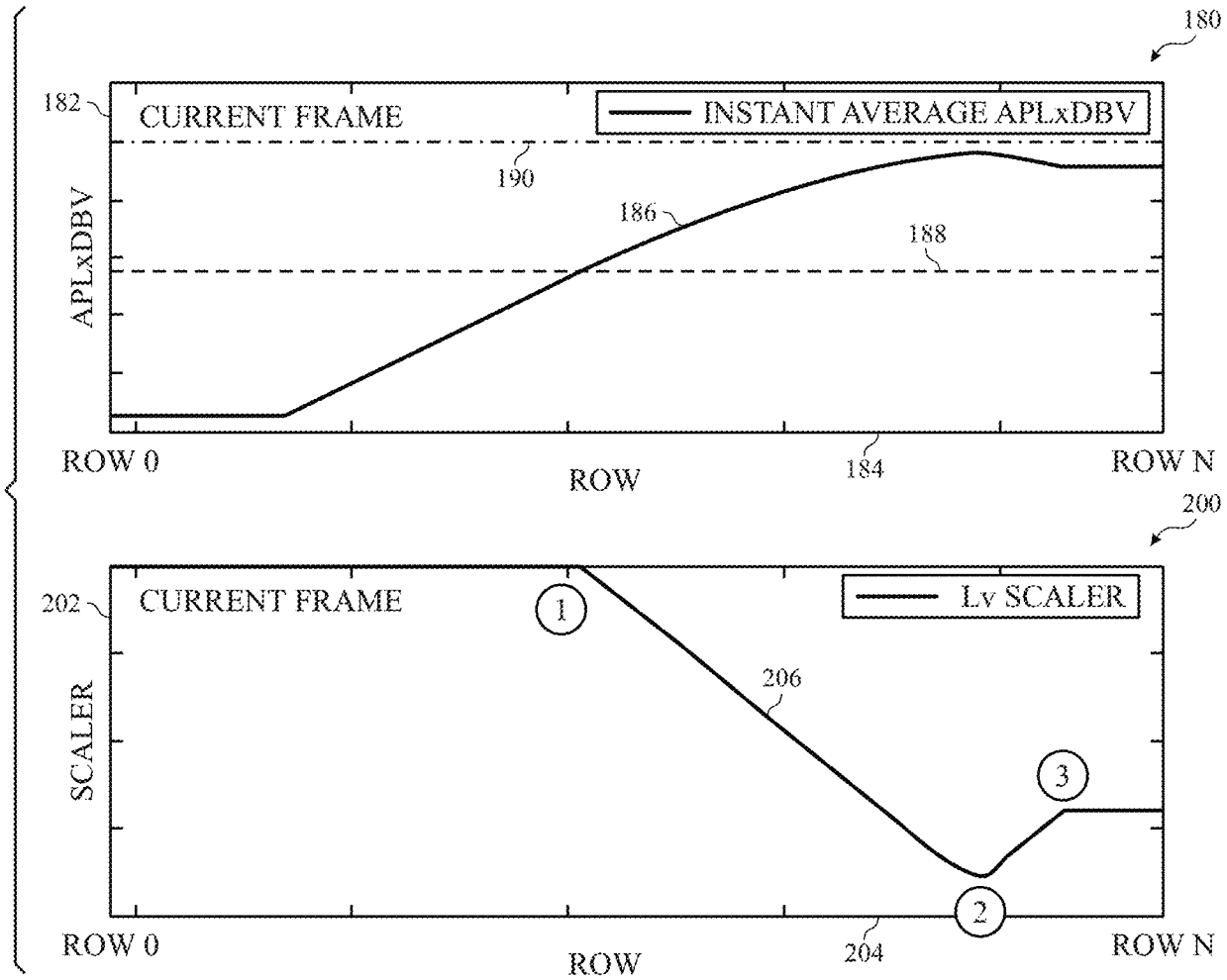
FIG. 14 represents two plots showing instantaneous luminance output by the electronic display and luminance scaling for the example of FIG. 13, in accordance with an embodiment.

FIGS. 13 and 14 illustrate the use of the intra-frame luminance scaling 74 in an example where the electronic display 12 changes from displaying a previous frame 170 to a current frame 172. A plot 180 of FIG. 14 represents a total luminance emitted by the electronic display 12 (ordinate 182) for the rows of display pixels (abscissa 184) programmed for the current frame 172. A curve 186 illustrates the total luminance (e.g., the instantaneous average pixel luminance (APL) as multiplied by the global display brightness value (DBV)). A scaling threshold 188 marks a total luminance above which point luminance scaling is used in an effort to avoid reaching a maximum total luminance 190, above which the electronic display 12 would draw too much power from the power supply 26. A plot 200 of FIG. 14 plots the scaling value (ordinate 202) for the rows of display pixels (abscissa 204) to be programmed for the current frame 172. A curve 206 represents a scaling value applied to the image data across the current frame 172.

As can be seen in FIG. 13, the previous frame 170 contains some dark pixels and some bright pixels from Row 0 to Row N. As such, the curve 186 of FIG. 14 initially shows a relatively low total luminance over one frame at the start of the programming of the current frame 172. That is, when the current frame 172 begins to be programmed, the total luminance of the electronic display is due entirely to the previous frame 170. Since the first several rows of image data of the current frame 172 programmed into the electronic display 12 are the same as the first several rows of image data of the previous frame 170 that it is replacing, the total pixel luminance shown in the curve 186 initially remains the same. However, as seen by the curve 186 of FIG. 14, for rows where bright pixels of the current frame 172 begin replacing dark pixels from the previous frame 170, the total luminance of the electronic display 12 begins to increase.

Eventually, as more and more rows of display pixels change from dark (previous frame 170) to bright (current frame 172), the total luminance shown by the curve 186 increases to a point where luminance scaling is warranted. This point is labeled "1" in FIGS. 13 and 14. At point "1," the total luminance of curve 186 crosses the scaling threshold 188. The image data is scaled by an amount corresponding to the curve 206, which begins at point "1." Initially, the luminance scaling is relatively moderate, but the luminance scaling may become more severe as the total luminance of the curve 186 approaches the maximum total luminance 190. At point "2," the image data changes less between the previous frame 170 to the current frame 172. Thus, the amount of scaling may decrease. At point "3," the image data is the same for both the previous frame 170 and the current frame 172, so the total pixel luminance shown by the curve 186 does not change.

FIGS. 15-20 represent the types of scaling functions that may be applied to image data to prevent the electronic display 12 from drawing excessive power while under some conditions allowing for exceptionally high brightness under others. The scaling functions shown in FIGS. 15-20 represent scaling that may be applied based at least in part on instantaneous average pixel luminance (APL) for a particular global display brightness value (DBV). As may be appreciated, a collection of different functions for different global display brightness values may be used to form a two-dimensional lookup table indexed to instantaneous average pixel luminance and global display brightness value.

Figure 15:
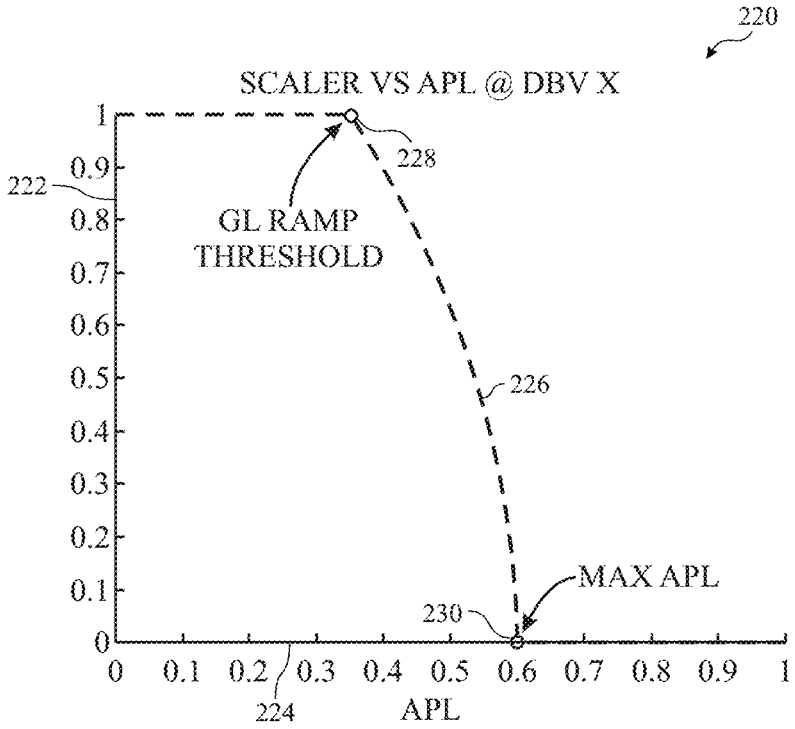
FIG. 15 represents an example plot for applying intra-frame luminance scaling as a function of instantaneous average pixel luminance for a particular global display brightness value, as used in the example of FIG. 13, in accordance with an embodiment.
Figure 16:
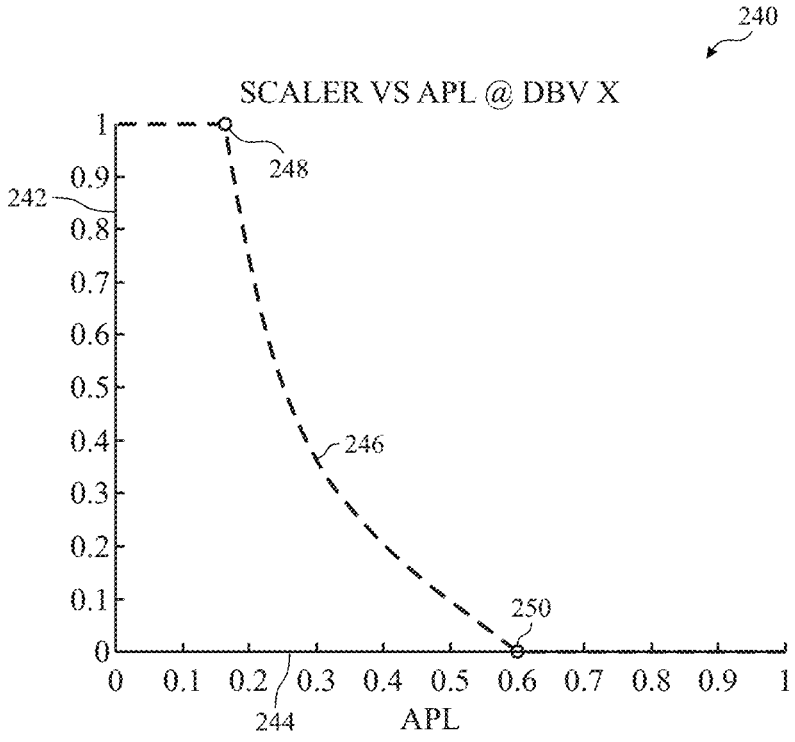
FIG. 16 represents another example plot for applying intra-frame luminance scaling as a function of instantaneous average pixel luminance for a particular global display brightness value, in accordance with an embodiment.
Figure 17:
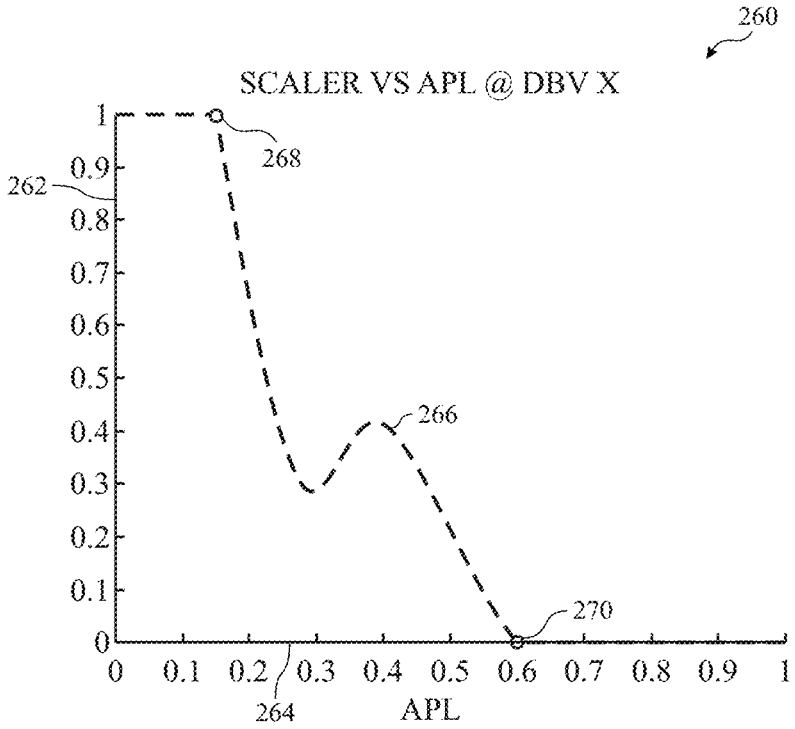
FIG. 17 represents another example plot for applying intra-frame luminance scaling as a function of instantaneous average pixel luminance for a particular global display brightness value, in accordance with an embodiment.

FIG. 15 is a plot 220 of scaling value (ordinate 222) in relation to instantaneous average pixel luminance (abscissa 224) for a particular global display brightness value (DBV "X"). A curve 226 represents a scaling value that is applied depending on the instantaneous average pixel luminance. As shown by the curve 226, as the instantaneous average pixel luminance increases, the scaling value is initially 1, meaning no change to the image data. At a point 228, the curve 226 reaches a gray level ramp threshold, marking an instantaneous average pixel luminance beyond which the luminance of the image data may begin to be scaled. This may continue according to any suitable function (here, one that scales down more rapidly as instantaneous average pixel luminance increases) until reaching a maximum instantaneous average luminance at point 230. The point 230 represents the maximum instantaneous average luminance that the electronic display 12 can sustain at this global display brightness value (DBV "X"). Beyond the point 230, the curve 226 corresponds to a scale value of "0" that is applied to the image data to prevent the electronic display 12 from drawing too much power from the power supply. As may be appreciated, the gray level ramp threshold of point 228 and the maximum instantaneous average luminance of point 230 may differ for different values of the global display brightness value. Likewise, the particular function to ramp down scaling values between the points 228 and 230 may also differ for different values of the global display brightness value.

Indeed, any suitable functions for scaling the luminance of image data for display on the electronic display may be used. In an example shown in FIG. 16, a plot 240 illustrates scaling value (ordinate 242) in relation to instantaneous average pixel luminance (abscissa 244) for a particular global display brightness value (DBV "X"). A curve 246 represents a scaling value that is applied depending on the instantaneous average pixel luminance. A point 248 marks a gray level ramp threshold, representing an instantaneous average pixel luminance beyond which the luminance of the image data may begin to be scaled. A point 250 represents a maximum instantaneous average luminance that the electronic display 12 can sustain at this global display brightness value (DBV "X"). From the point 248, the curve 246 initially scales more rapidly in relation to instantaneous average pixel luminance before scaling more slowly until reaching the point 250.

The luminance scaling function may or may not scale the image data monotonically with respect to instantaneous average pixel luminance. In an example shown in FIG. 17, a plot 260 illustrates scaling value (ordinate 262) in relation to instantaneous average pixel luminance (abscissa 264) for a particular global display brightness value (DBV "X"). A curve 266 represents a scaling value that is applied depending on the instantaneous average pixel luminance. A point 268 marks a gray level ramp threshold, representing an instantaneous average pixel luminance beyond which the luminance of the image data may begin to be scaled. A point 270 represents a maximum instantaneous average luminance that the electronic display 12 can sustain at this global display brightness value (DBV "X"). From the point 268, the curve 266 may decrease, then increase, then decrease again until reaching the point 270.

Figure 18:
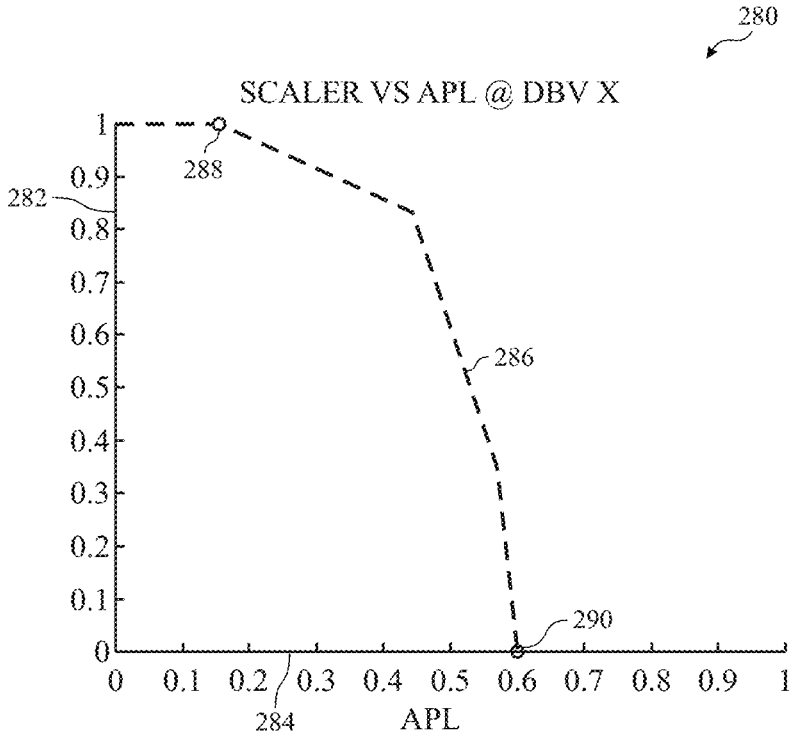
FIG. 18 represents another example plot for applying intra-frame luminance scaling as a function of instantaneous average pixel luminance for a particular global display brightness value, in accordance with an embodiment.
Figure 19:
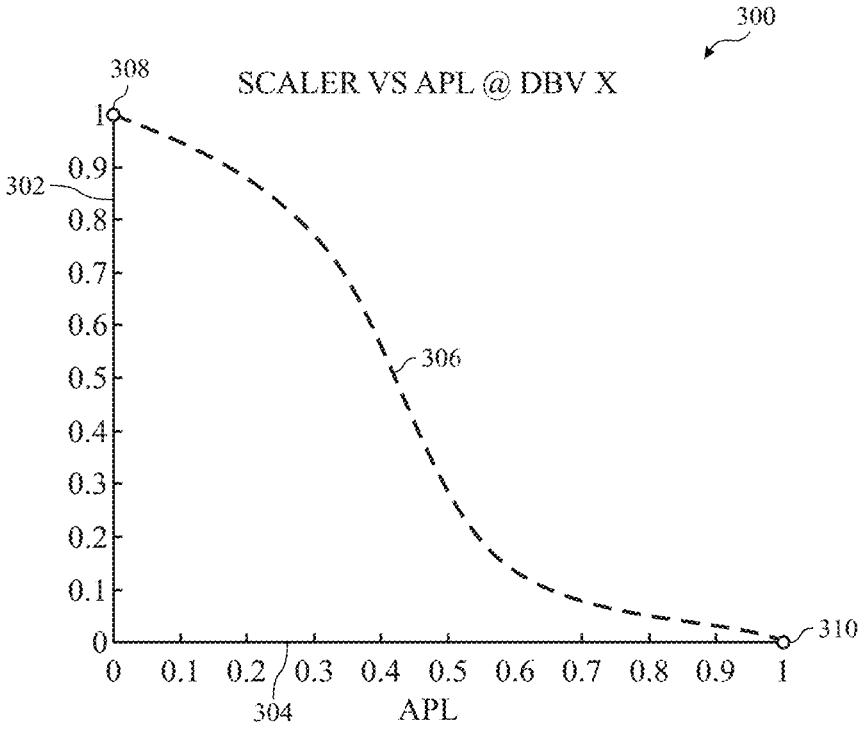
FIG. 19 represents another example plot for applying intra-frame luminance scaling as a function of instantaneous average pixel luminance for a particular global display brightness value, in accordance with an embodiment.

The luminance scaling function may be piecewise, as illustrated by a plot 280 of FIG. 18. In the example shown in FIG. 18, the plot 280 illustrates scaling value (ordinate 282) in relation to instantaneous average pixel luminance (abscissa 284) for a particular global display brightness value (DBV "X"). A curve 286 represents a scaling value that is applied depending on the instantaneous average pixel luminance. A point 288 marks a gray level ramp threshold, representing an instantaneous average pixel luminance beyond which the luminance of the image data may begin to be scaled. A point 290 represents a maximum instantaneous average luminance that the electronic display 12 can sustain at this global display brightness value (DBV "X"). From the point 288, the curve 286 may have one or more piecewise linear segments that each may have its own function. In this example, there are three linear segments with fixed slopes. In other examples, however, there may be any suitable number of segments, and each segment may be different functions with changing slopes.

For certain global display brightness values, the luminance scaling function may scale all image data, even when the instantaneous average pixel luminance is relatively low. In an example shown in FIG. 19, a plot 300 illustrates scaling value (ordinate 302) in relation to instantaneous average pixel luminance (abscissa 304) for a particular global display brightness value (DBV "X"). A curve 306 represents a scaling value that is applied depending on the instantaneous average pixel luminance. A point 308 marks a gray level ramp threshold, representing an instantaneous average pixel luminance beyond which the luminance of the image data may begin to be scaled. A point 310 represents a maximum instantaneous average luminance that the electronic display 12 can sustain at this global display brightness value (DBV "X"). From the point 308, the curve 306 may decrease according to any suitable function until reaching the point 310.

Figure 20:
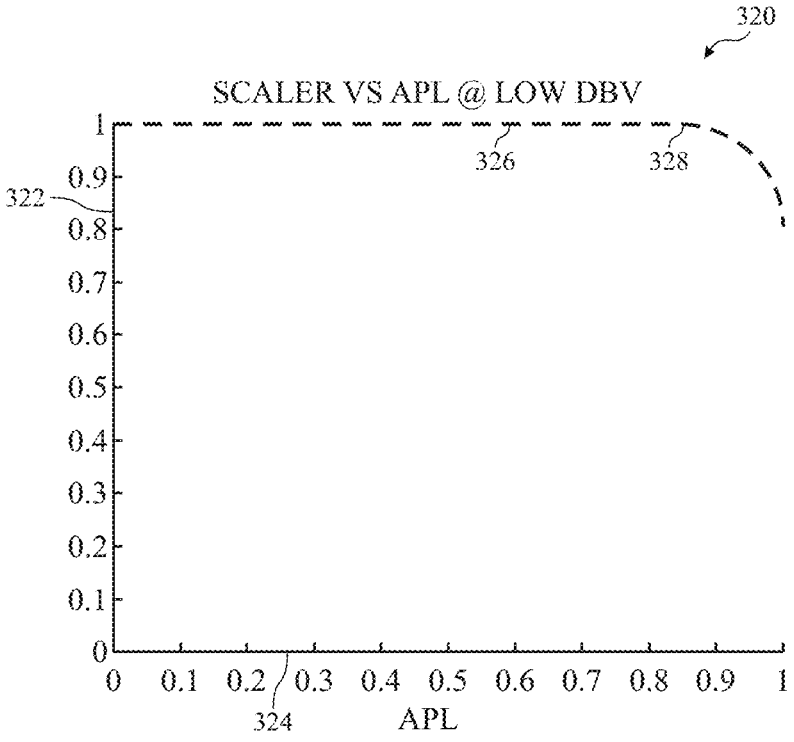
FIG. 20 represents another example plot for applying intra-frame luminance scaling as a function of instantaneous average pixel luminance for a particular global display brightness value, in accordance with an embodiment.

For particularly low global display brightness values, the luminance scaling function may only begin to scale image data when the instantaneous average pixel luminance is particularly high. One example is shown in FIG. 20. In the example of FIG. 20, a plot 320 illustrates scaling value (ordinate 322) in relation to instantaneous average pixel luminance (abscissa 324) for a global display brightness value that is among the lower possible global display brightness values. A curve 326 represents a scaling value that is applied depending on the instantaneous average pixel luminance. A point 328 marks a gray level ramp threshold, representing an instantaneous average pixel luminance beyond which the luminance of the image data may begin to be scaled. With this luminance scaling applied, the electronic display 12 at this global display brightness value may not reach a maximum instantaneous average luminance. Thus, the curve 326 may not scale the image data to "0," even at the maximum instantaneous average pixel luminance.

Figure 21:
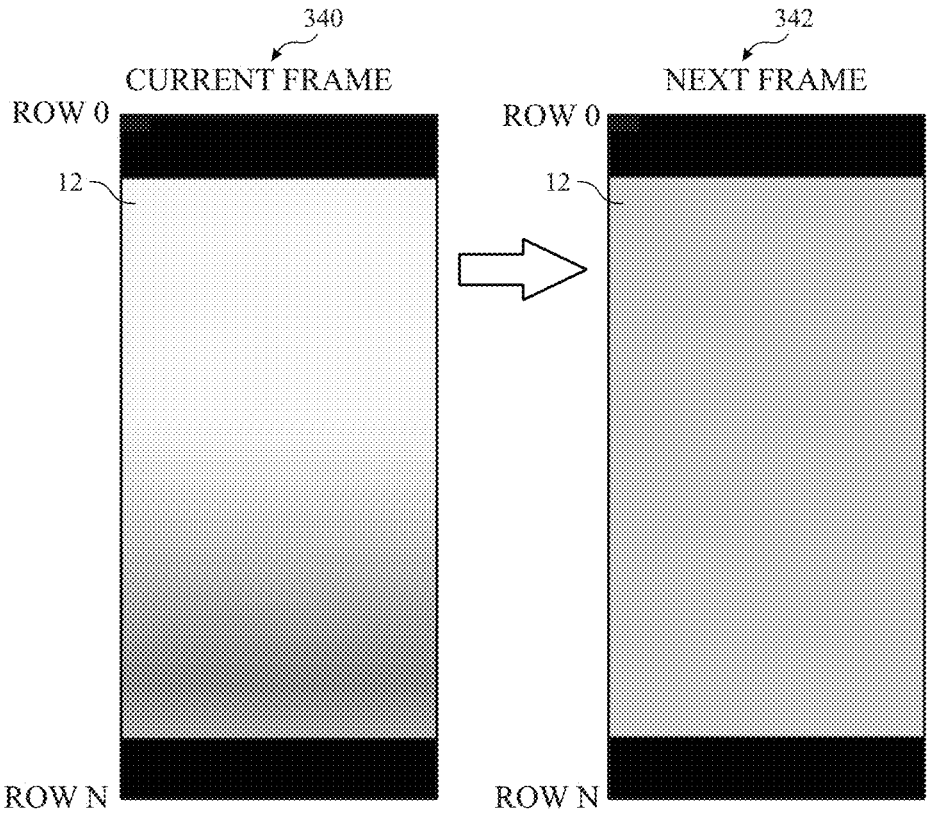
FIG. 21 illustrates an example of adjusting a global display brightness value from a current frame to a next frame based at least in part on intra-frame luminance scaling in the current frame, in accordance with an embodiment.

In the event that the intra-frame luminance scaling 74 causes the luminance of the image data to be scaled down, the global display brightness value may be reduced in a subsequent frame. An example is shown in FIG. 21, where a current frame 340 on the electronic display 12 has been scaled. In a next frame 342, the global display brightness value may be set lower, so that luminance scaling may be avoided for the next frame 342.

Figure 22:
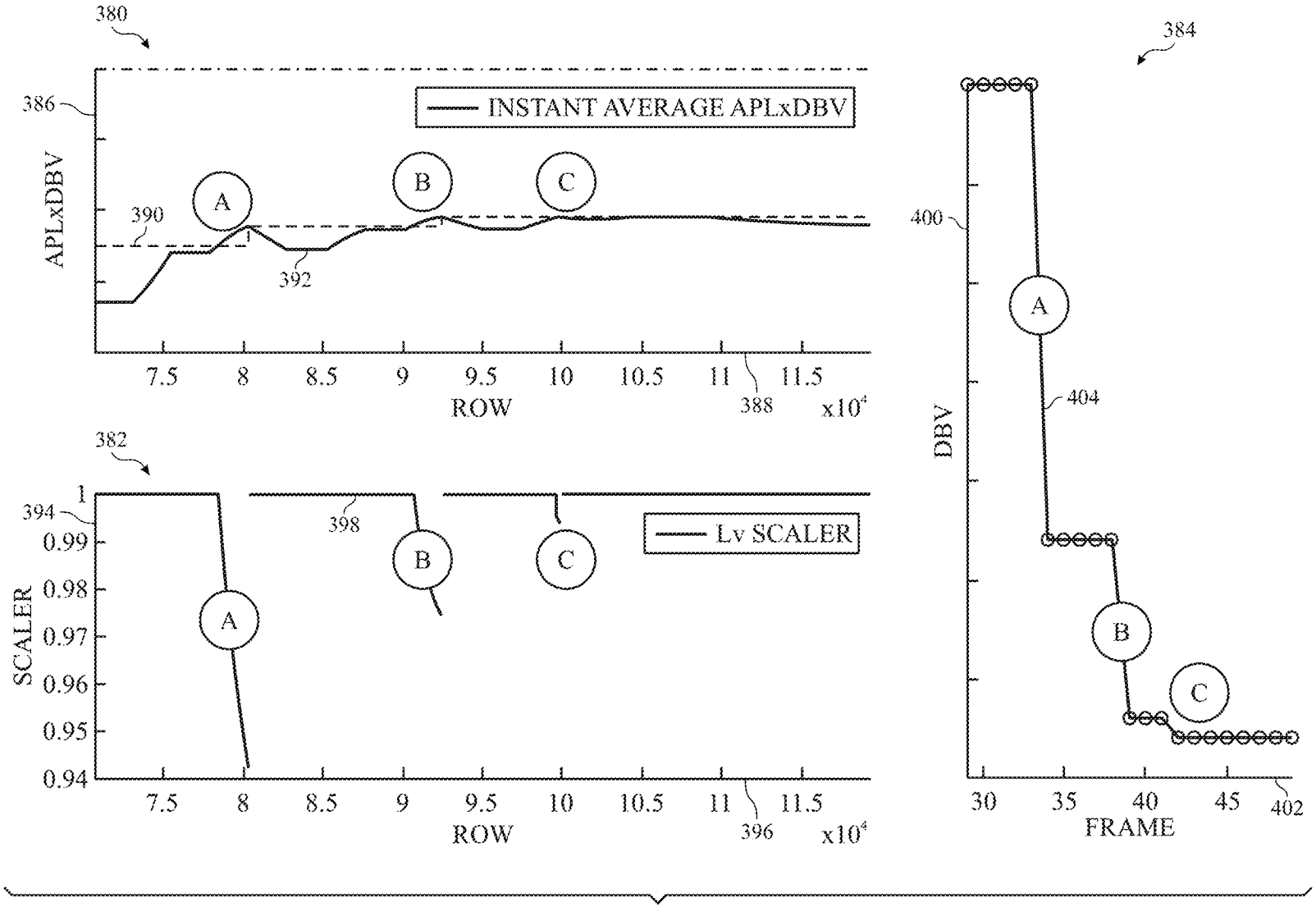
FIG. 22 represents a series of plots that illustrate another example of adjusting the global display brightness value of the electronic display over a series of image frames, in accordance with an embodiment.

A series of plots 380, 382, and 384 of FIG. 22 provide another example of how the global display brightness value may be changed over a number of many image frames. The plot 380 represents the total instantaneous luminance emitted by the electronic display 12 (instantaneous average pixel luminance (APL) multiplied by the global display brightness value (DBV)) (ordinate 386) in relation to rows programmed into the electronic display 12 (abscissa 388). The abscissa 388 represents 10,000s of rows of image data programmed onto the electronic display 12, such that the plot 380 represents approximately 20 or so frames of image data.

A scaling threshold 390 marks a total luminance above which point luminance scaling is used in an effort to avoid reaching a maximum total luminance. As can be seen in the plot 380, the scaling threshold 390 changes as thousands of rows (many image frames) are programmed over time onto the electronic display 12. This corresponds to changes in global display brightness values for different image frames, occurring at point "A," point "B," and point "C." These points are also seen in the plots 382 and 384, discussed further below. A curve 392 represents the total luminance (e.g., the instantaneous average pixel luminance (APL) as multiplied by the global display brightness value (DBV)) emitted by the electronic display 12 at the point of programming display pixels of a particular row.

The plot 382 represents a scaling value applied to image data (ordinate 394) in relation to rows programmed into the electronic display 12 (abscissa 396). The abscissa 396 also represents 10,000s of rows of image data programmed onto the electronic display 12 and corresponds to the same 20 or so frames of image data as in the plot 380. A curve 398 illustrates the way that luminance scaling may be applied to image data by the intra-frame luminance scaling 74 as different frames of image data are provided to the electronic display 12. At point "A," point "B," and point "C," luminance scaling takes place to prevent the electronic display 12 from drawing too much power from the power supply 26.

As shown in the plot 384, which shows the global display brightness value (DBV) (ordinate 400) for a current image frame (abscissa 402), it is in response to this image data that the global display brightness value may be reduced. As shown by a curve 404 of the plot 384, the global display brightness value may drop at point "A," then at point "B," and then again at point "C." As a consequence, as shown in the plot 380, the scaling threshold 390 may be increased. As mentioned above, the global display brightness value may be reduced so that a subsequent image frame (e.g., the next image frame or another future image frame) may avoid luminance scaling if the image data remained the same. In another example, the global display brightness value for a subsequent image frame may be selected to result in some threshold amount of luminance scaling if the image data remained the same.

The specific embodiments described above have been shown by way of example, and it should be understood that these embodiments may be susceptible to various modifications and alternative forms. Indeed, while the disclosure has referred to scaling the luminance of image data to prevent self-emissive pixels of an electronic display from drawing too much power, this may also be applied to electronic displays with a one- or two-dimensional backlight. In that case, the luminance of backlighting may be accumulated as the backlight changes from row to row or image frame to image frame. The amount of light emitted by the backlight may be scaled as appropriate to keep the electronic display from exceeding the power consumption provided by a power supply. It should be further understood that the claims are not intended to be limited to the particular forms disclosed, but rather to cover all modifications, equivalents, and alternatives falling within the spirit and scope of this disclosure.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

What is claimed is:

1. A system comprising:

processing circuitry configured to provide image data; and an electronic display configured to display the image data;

wherein the processing circuitry or the electronic display, or both, are configured to monitor an instantaneous average pixel luminance of the electronic display and perform luminance scaling on a subset of a current frame of the image data based at least in part on the instantaneous average pixel luminance to prevent the electronic display from exceeding a power threshold when displaying the current frame of the image data on the electronic display, and wherein the instantaneous average pixel luminance corresponds partly to rows of the current frame of the image data and partly to rows of a previous image frame.

2. The system of claim 1, wherein the instantaneous average pixel luminance of the electronic display comprises an average pixel luminance of the image data currently being displayed by the electronic display.

3. The system of claim 1, wherein the processing circuitry or the electronic display, or both, are configured to monitor the instantaneous average pixel luminance of the electronic display at least in part by accumulating average pixel luminances for rows of the electronic display.

4. The system of claim 3, wherein the average pixel luminances for the rows of the electronic display are averaged over a total number of the rows of the electronic display.

5. The system of claim 3, wherein the average pixel luminances for some of the rows are due to the current frame of the image data and the average pixel luminances for other of the rows are due to a previous frame of the image data.

6. The system of claim 1, wherein the subset of the current frame of the image data comprises a row of pixels of image data corresponding to a row of display pixels of the electronic display.

7. The system of claim 1, wherein a processing block of a display pipeline of the processing circuitry is configured to monitor the instantaneous average pixel luminance and perform the luminance scaling.

8. The system of claim 1, wherein the processing circuitry is configured to monitor the instantaneous average pixel luminance and perform the luminance scaling at least in part by executing instructions stored in memory.

9. The system of claim 1, wherein display driver circuitry of the electronic display is configured to monitor the instantaneous average pixel luminance and perform the luminance scaling.

10. The system of claim 9, wherein performing the luminance scaling comprises adjusting gamma circuitry to adjust a generation of programming signals for programming display of the electronic display.

11. The system of claim 1, wherein the processing circuitry or the electronic display, or both, are configured to cause a global display brightness value of the electronic display to be reduced for a subsequent frame of the image data when the luminance scaling on the subset of the current frame of the image data results in a reduction of luminance of the subset of the current frame of the image data.

12. A method comprising:

determining an instantaneous average pixel luminance of an electronic display corresponding to an amount of light currently being emitted by the electronic display, wherein the instantaneous average pixel luminance corresponds partly to rows of a current image frame and partly to rows of a previous image frame; and determining, based at least in part on the instantaneous average pixel luminance, a luminance scaling value by which to scale a luminance of a row of image data corresponding to the current image frame that is yet to be displayed on the electronic display.

13. The method of claim 12, wherein determining the instantaneous average pixel luminance comprises accumulating an average pixel luminance of all display pixels of the electronic display over a total of one image frame including part of the current image frame and part of the previous image frame.

14. The method of claim 12, wherein determining the instantaneous average pixel luminance comprises computing an average pixel luminance for the rows of the current image frame and for the rows of the previous image frame.

15. The method of claim 12, comprising selecting a global display brightness value based at least in part on the instantaneous average pixel luminance.

16. The method of claim 12, comprising selecting a global display brightness value based at least in part on the instantaneous average pixel luminance.

17. A system for intra-frame luminance scaling comprising:

row-by-row luminance accumulation circuitry configured to monitor an instantaneous average pixel luminance for an electronic display corresponding partly to rows of a current image frame and partly to rows of a previous image frame; and luminance scaling circuitry configured to determine a luminance scaling value by which to scale a luminance of a subset of the current image frame before the subset of the current image frame is programmed onto the electronic display to prevent the instantaneous average pixel luminance for the electronic display from exceeding a limit.

18. The system of claim 17, wherein the row-by-row luminance accumulation circuitry comprises a 1-column buffer configured to store row values of average pixel luminance.

19. The system of claim 17, wherein the luminance scaling circuitry is configured to determine the luminance scaling value based at least in part on a global display brightness value for the electronic display.

20. The system of claim 17, comprising global brightness adjustment circuitry that comprises a two-dimensional lookup table indexed to the instantaneous average pixel luminance and a global display brightness value for the electronic display.

21. The system of claim 17, wherein the luminance scaling circuitry is configured to determine the luminance scaling value based at least in part on a function that causes luminance to be scaled differently at different values of instantaneous average pixel luminance.

22. The system of claim 17, wherein the system is at least partly disposed in image processing display pipeline circuitry for an electronic device.

23. The system of claim 17, wherein the system is at least partly disposed in display driver circuitry of the electronic display.

24. An article of manufacture comprising one or more tangible, non-transitory, machine-readable instructions that, when executed by a processor, cause the processor to:

accumulate an instantaneous average pixel luminance for an electronic display corresponding to a first subset of display pixels of the electronic display that are currently displaying image data corresponding to a first image frame and a second subset of display pixels of the electronic display that are currently displaying image data corresponding to a second image frame; and determine, based at least in part on the instantaneous average pixel luminance, a luminance scaling value by which to scale a luminance of a row of image data corresponding to the first image frame that is yet to be displayed on the electronic display.

25. The article of manufacture of claim 24, wherein the luminance scaling value is determined based at least in part on a function of the instantaneous average pixel luminance and a global display brightness value.

* * * * *